United States Patent [19]

Eacobacci et al.

[11] Patent Number: 4,655,046

[45] Date of Patent: Apr. 7, 1987

[54] CRYOPUMP WITH EXHAUST FILTER

[75] Inventors: Michael J. Eacobacci, Randolph; David C. Planchard, Shrewsberry, both of Mass.

[73] Assignee: Helix Technology Corporation, Waltham, Mass.

[21] Appl. No.: 757,003

[22] Filed: Jul. 19, 1985

[51] Int. Cl.[4] ..... B01D 8/00

[52] U.S. Cl. ..... 62/55.5; 55/269; 62/268; 417/901

[58] Field of Search ..... 62/55.5, 100, 268; 417/901; 55/269

[56] References Cited

U.S. PATENT DOCUMENTS 3,552,485 1/1971 Le Jannou et al. ..... 62/55.5

4,311,023 1/1982 Watral ..... 62/475

4,446,702 5/1984 Peterson et al. ..... 62/55.5

*Primary Examiner*—Ronald C. Capossela

*Attorney, Agent, or Firm*—Hamilton, Brook, Smith & Reynolds

[57] ABSTRACT

An exhaust port from a cryopump vacuum vessel leads to an exhaust valve. The valve is protected from contamination by a filter standpipe which extends from the exhaust port into the vacuum vessel and which is open at its end opposite to the exhaust port. The standpipe is of porous material which allows the free flow of gas, water, and liquid cryogens therethrough while retaining contaminating debris within the vacuum vessel. The filter conduit is of screen formed into a cylinder. One end is tapered and pressed into the exhaust conduit. The screen cylinder is stopped in the exhaust conduit by a circumferential ridge.

10 Claims, 2 Drawing Figures

CRYOPUMP WITH EXHAUST FILTER

DESCRIPTION

BACKGROUND

Cryopumps currently available, whether cooled by open or closed cryogenic cycles, generally follow the same design concept. A low temperature array, usually operating in the range of 4 to 25 K, is the primary pumping surface. This surface is surrounded by a higher temperature radiation shield, usually operated in the temperature range of 70 to 130 K, which provides radiation shielding to the lower temperature array. The radiation shield generally comprises a housing which is closed except at a frontal array positioned between the primary pumping surface and the chamber to be evacuated. This higher temperature, first stage frontal array serves as a pumping site for higher boiling point gases such as water vapor.

In operation, high boiling point gases such as water vapor are condensed on the frontal array. Lower boiling point gases pass through that array and into the volume within the radiation shield and condense on the lower temperature array. A surface coated with an adsorbent such as charcoal or a molecular sieve operating at or below the temperature of the colder array may also be provided in this volume to remove the very low boiling point gases such as hydrogen. With the gases thus condensed and/or adsorbed onto the pumping surfaces, only a vacuum remains in the work chamber.

Once the high vacuum has been established, work pieces may be moved into and out of the work chamber through partially evacuated load locks. With each opening of the work chamber to the load lock, additional gases enter the work chamber. Those gases are then condensed onto the cryopanels to again evacuate the chamber and provide the necessary low pressures for processing. After continued processing, perhaps over several weeks, gases condensed or adsorbed on the cryopanels would have a volume at ambient temperature and pressure which substantially exceeds the volume of the cryopump chamber. If the cryopump shuts down, that large volume of captured gases is released into the cryopump chamber. To avoid dangerously high pressures in the cryopump with the release of the captured gases a pressure relief valve is provided. Typically, the pressure relief valve is a spring-loaded valve which opens when the pressure in the cryopump chamber exceeds about 3 pounds per square inch gauge. Because the process gases may be toxic, the pressure relief valve is often enclosed within a housing which directs the gases through an exhaust conduit.

After several days or weeks of use, the gases which have condensed onto the cryopanels and, in particular, the gases which are adsorbed begin to saturate the system. A regeneration procedure must then be followed to warm the cryopump and thus release the gases and to remove the gases from the system. As the gases are released, the pressure in the cryopump increases and the gases are exhausted through the pressure relief valve.

A typical pressure relief valve includes a cap which, when the valve is closed, is held against an o-ring seal by a spring. With pressures which open the valve, the cap is pushed away from the o-ring seal and the exhausted gases flow past the seal. Along with the gas, debris such as particles of charcoal from the adsorber or other debris resulting from processing within the work chamber also pass the seal. That debris often collects on the o-ring seal and the closure cap. In order to effect a tight vacuum after regeneration it is often necessary to clean the relief valve after each regeneration procedure. If such care is not taken, leaks into the cryopump result at the relief valve and provide an undesired load on the cryopump.

After the gases have been released from the cryopanels and cryopump chamber, a vacuum is again created in the cryopump. Before cooling the cryopump to cryogenic temperatures, however, the cryopump must first be rough pumped to remove essentially all water vapor from the cryopump chamber and reduce the pressure in the chamber to a level at which the cryopump may operate. A valve is positioned between the cryopump chamber and the rough pump and that valve is also subject to contamination from debris. As with the pressure relief valve, such contamination can result in leaks which prevent effficient operation of the cryopump.

Several approaches have been suggested for contamination. One approach has been to provide a self-cleaning valve which isolates the o-ring in a relief valve from contaminants. Such an approach increases the complexity of the relief valve. Another approach has been to position a filter in the exhaust conduit to the relief valve. However, to eliminate the danger of an extreme pressure buildup in the case of clogging of the filter, a pressure relief of the filter itself is required. Another approach has been to prevent the debris from reaching the exhaust conduit by positioning a stand pipe at the opening to the conduit. The standpipe causes the debris to collect at the bottom of the cryopump housing. An equivalent arrangement is to position the exhaust port along the sidewall of a cryopump chamber rather than at its base. These latter approaches result in the collection of liquid cryogens and water in the cryopump chamber during the regeneration process and thus significantly increases the regeneration time and the rough pumping time subsequent to regeneration.

DISCLOSURE OF THE INVENTION

In accordance with the present invention the vacuum vessel of a cryopump has an exhaust port which is closed by a valve during operation of the cryopump. The cryopump further comprises a filter conduit extending from the exhaust port into the volume within the vacuum vessel of the cryopump. The conduit is formed of porous filter material which retains solid debris within the vacuum vessel but passes liquid and gas therethrough. The conduit is open at its end away from the exhaust port in order to permit substantially unrestricted flow of gas to the exhaust port, thereby alleviating the need for pressure relief of the filter. Preferably, the filter conduit is a cylindrical element which extends to a position near to the base of the radiation shield but is spaced therefrom to allow free flow of gas into the filter conduit. Alternatively, a cap may be positioned over the end of the conduit to prevent debris from dropping into the conduit but to allow free flow of gas into the conduit. The filter conduit is preferably a cylindrical screen which is tapered at one end to permit that end to be pressed into the exhaust port so that it is retained therein by a force fit. A screen having a 0.007 inch opening width has been found particularly suited to most cryopump applications.

BRIEF DESCRIPTION OF THE DRAWINGS

The foregoing and other objects, features, and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed upon illustrating the principles of the inventions.

DESCRIPTION OF A PREFERRED EMBODIMENT

Figure 1:
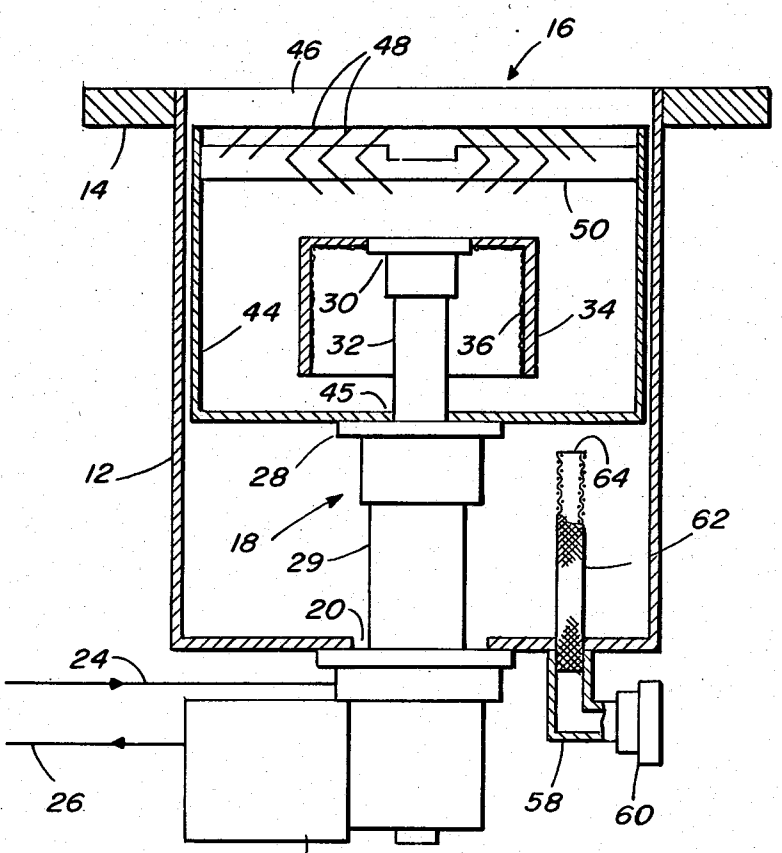
FIG. 1 is a cross sectional view of a cryopump embodying the present invention.

The cryopump of FIG. 1 comprises a main housing 12 which is mounted to a work chamber or a valve housing along a flange 14. A front opening 16 in the cryopump housing 12 communicates with a circular opening in the work chamber or valve housing. Alternatively, the cryopump arrays may protrude into the chamber and a vacuum seal be made at a rear flange. A two stage cold finger 18 of a refrigerator protrudes into the housing 12 through an opening 20. In this case, the refrigerator is a Gifford-MacMahon refrigerator but others may be used. A two stage displacer in the cold finger 18 is driven by a motor 22. With each cycle, helium gas introduced into the cold finger under pressure through line 24 is expanded and thus cooled and then exhausted through line 26. Such a refrigerator is disclosed in U.S. Pat. No. 3,218,815 to Chellis et al. A first stage heat sink, or heat station 28 is mounted at the cold end of the first stage 29 of the refrigerator. Similarly, a heat sink 30 is mounted to the cold end of the second stage 32.

The primary pumping surface is a cryopanel 34 mounted to the heat sink 30. In the case shown the cryopanel 34 is an inverted cup 34.

A cup shaped radiation shield 44 is mounted to the first stage, high temperature heat sink 28. The second stage of the cold finger extends through an opening 45 in that radiation shield. This radiation shield 44 surrounds the primary cryopanel array to the rear and sides to minimize heating of the primary cryopanel array by radiation. The temperature of this radiation shield ranges from about 100 K at the heat sink 28 to about 130 K adjacent to the opening 16.

A frontal cryopanel array 46 serves as both a radiation shield for the primary cryopanel array and as a cryopumping surface for higher boiling temperature gases such as water vapor. This panel comprises a circular array of concentric louvers and chevrons 48 joined by spoke-like plates 50. The configuration of this cryopanel 46 need not be confined to circular concentric components; but it should be so arranged as to act as a radiant heat shield and a higher temperature cryopumping panel while providing a path for lower boiling temperature gases to the primary cryopanel.

In a typical system, the cryopump is regenerated by turning off the refrigerator and allowing the system to warm. As the temperature of the system increases the gases are released, thus increasing the pressure in the system. As the pressure reaches about 3 PSIG the released gases are exhausted from the system through an exhaust conduit 58 and a relief valve 60.

In accordance with the present invention, an additional exhaust conduit 62 extends upwardly from the inlet port of the conduit 58 at the base of the cryopump housing 12. The conduit 62 is formed of filter material such that liquid cryogens and water which collect at the bottom of the housing 12 are free to flow therethrough into the exhaust conduit 58. However, the filter material has sufficiently small openings to retain debris which might contaminate the exhaust valve 60. The diameter of the average pore size needed to initiate the free flow of fluids can be determined by the following relation:

$$d = \frac{K\,4\,\sigma\cos\theta}{\Delta P}$$

where d= average pore diameter $\sigma$= surface tension of the fluid $\theta$= liquid-solid contact angle $\Delta$P= head pressure of the fluid K= shape correction factor The maximum diameter of the pore which will effectively remove the contamination that will cause vent valve leakage can be determined empirically for specific applications. An opening size of 0.007 inch has been found suited to most applications. A specific filter material used has been an 80 mesh stainless steel screen formed into a cylinder. The screen is of 0.0055 inch wire and has a 31.4 per cent open area.

The end 64 of the filter conduit is open to allow for free flow of gas through the filter conduit and conduit 58 to the exhaust valve 60. Thus, there is no danger of a buildup of pressure in the cryopump housing due to clogging of the filter. The diameter of the filter conduit of about 0.7 inch matches that of the conduit 58 and the filter conduit extends no closer than about 0.7 inch to the base of the radiation shield 44; thus, free flow of gas through the end opening and the filter conduit is assured. On the other hand, debris which usually collects along the base of the cryopump housing 12 is not likely to flow over the top rim of the filter conduit and thus bypass the filter. A filter conduit length of at least about four inches raises the opening 64 above the zone in which the debris is stirred during the turbulent regeneration process. A preferred system uses a 6.5 inch filter conduit. Further, by being positioned near to the under surface of the radiation shield 44, debris is not likely to drop into the end 64 of the conduit.

Figure 2:
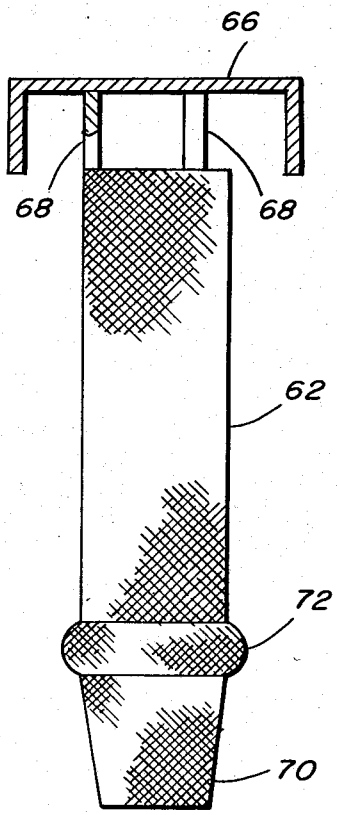
FIG. 2 is an enlarged view of a filter conduit having an optional endcap thereon.

As an alternative to positioning the end of the conduit close to the radiation shield 44, an endcap 66 may be positioned on the filter conduit as shown in FIG. 2. The endap 66 is shown as being supported by three legs 68 sufficiently far from the end of the filter conduit to allow free flow of gas into that end of the conduit.

The enlarged view of the filter conduit 62 of FIG. 2 illustrates the shape of the base end of the conduit which allows for ease of retrofitting into conventional cryopumps. The filter is tapered at its end 70 so that it can be pressed into the exhaust port into the conduit 58 and be retained therein by a force fit. A circumferential ridge 72 may be provided about the filter conduit to serve as a stop as the filter is pressed into the conduit 58.

The filter standpipe of this invention has several advantages over prior approaches to avoiding contamination of exhaust valves in cryopumps. During the regeneration process liquid cryogens which are first released from the warming cryopuming surfaces are apt to form a pool at the base of the cryopump housing 12 prior to being carried through the exhaust tube 58 with exhausted gases. Those liquid cryogens cool the base of the cryopump housing and the connected refrigerator drive assembly. It is thus important that they be removed quickly so as not to overly cool the refrigerator operating mechanism and cause damage. Solid standpipes which have been suggested in the past prevent that rapid removal of liquid cryogens. In fact, such a system may retain the cryogens in liquid form even as the cryopump warms sufficiently to release water vapor therefrom. That water vapor can then be captured again by the liquid cryogens in the base of the cryopump housing. Subsequently, the water and ice collected in the base of the cryopump housing can only be removed by extensive rough pumping of the system before operating the refrigerator. Such is a long process.

Another disadvantage of all prior approaches is that they are mechanically more complex and more likely to result in virtual leaks in the cryopump system. A virtual leak is the result of small areas in the system which can entrap air during initial evacuation of the system but which then slowly outgas after the vacuum vessel is otherwise evacuated. The fixtures of solid standpipes and typical filter assemblies require special efforts to avoid such virtual leaks. In the present system, however, the filter conduit need only be pressed into the exhaust conduit which is already present in a cryopump. The openings in the filter material pressed into the exhaust conduit prevent the entrapment of the gas between that material and the inner surface of the exhaust conduit and, thus, prevent virtual leaks.

While the invention has been particularly shown and described with reference to a preferred embodiment thereof, it will be understood by those skilled in the art that various changes in form and details may be made therein without departing from the spirit and scope of the invention as defined by the appended claims. For example, filter material other than mesh, such as sintered material, may be utilized. Also, although the most significant advantages of the invention are obtained where the filter conduit extends from the base of the cryopump housing, the filtering advantages of the invention without the danger of filter clogging are obtained even where the filter conduit extends from a side of the cryopump housing. Such an orientation would result if the cryopump of FIG. 1 were mounted with the refrigerator cold finger in a horizontal position.

We claim:

1. A cryopump comprising cryopanels within a vacuum vessel cooled to cryogenic temperatures to condense gases from the volume within the vacuum vessel, the vacuum vessel having an exhaust port closed by a valve during operation of the cryopump, the cryopump further comprising a filter conduit extending from the exhaust port into the volume within the vacuum vessel away from the wall of the vacuum vessel, the filter conduit being formed of porous filter material for retaining solid debris within the vacuum vessel while passing liquid and gas therethrough, the filter conduit being open away from the exhaust port to permit substantially unrestricted flow of gas to the exhaust port.

2. A cryopump as claimed in claim 1 further comprising a radiation shield cooled by a first stage of a cryogenic refrigerator and surrounding a cryopanel cooled by a second stage of the cryogenic refrigerator within the vacuum vessel, the filter conduit being a cylinder open at its end opposite to the exhaust port with the open end of the filter conduit protected from falling debris by the radiation shield.

3. A cryopump as claimed in claim 1 further comprising an endcap supported away from the open end of the filter conduit to protect the open end from the falling debris while permitting free flow of gas into the open end.

4. A cryopump as claimed in claim 1 wherein the filter conduit is a single sheet of screen formed into a cylinder.

5. A cryopump as claimed in claim 4 wherein an end of the cylindrical screen is tapered and pressed into the exhaust port.

6. A cryopump as claimed in claim 5 wherein the cylindrical screen includes a circumferential ridge to stop movement of the screen into the exhaust port.

7. A cryopump as claimed in claim 4 wherein the cylindrical screen includes a circumferential ridge to stop movement of the screen into the exhaust port.

8. A cryopump as claimed in claim 4 wherein the openings in the screen are about 0.007 inches wide.

9. A cryopump as claimed in claim 1 wherein the openings in the screen are about 0.007 inches wide.

10. A cryopump as claimed in claim 1 wherein the filter conduit is a cylinder having one end pressed into the exhaust port.

* * * * *